US006816441B2

(12) United States Patent
Terzian

(10) Patent No.: US 6,816,441 B2
(45) Date of Patent: Nov. 9, 2004

(54) BICOMPONENT LAST MINUTE GRAPHICS FOR DIGITAL TIME DISPLAYS

(75) Inventor: Berj A. Terzian, Newbury, MA (US)

(73) Assignee: Equitime, Inc., Newbury, MA (US)

( * ) Notice: Subject to any disclaimer, the term of this patent is extended or adjusted under 35 U.S.C. 154(b) by 54 days.

(21) Appl. No.: 10/274,520

(22) Filed: Oct. 18, 2002

(65) Prior Publication Data

US 2004/0076082 A1 Apr. 22, 2004

(51) Int. Cl.[7] ..... G04C 19/00; G04C 17/00
(52) U.S. Cl. ..... 368/82; 368/239
(58) Field of Search ..... 368/82–84, 223, 368/239–242

(56) References Cited

U.S. PATENT DOCUMENTS 4,264,966 A 4/1981 Terzian
4,271,497 A 6/1981 Terzian
4,483,628 A 11/1984 Terzian
4,627,737 A 12/1986 Nance et al.
5,757,730 A 5/1998 Terzian
6,215,736 B1 4/2001 Terzian
6,286,991 B1 9/2001 Terzian
6,493,290 B1 12/2002 Terzian

*Primary Examiner*—Vit W. Miska
(74) *Attorney, Agent, or Firm*—Muserlian, Lucas and Mercanti

(57) ABSTRACT

Bicomponent graphics are provided for digital time displays that display the last remaining minute before commencement of a next hour, comprising a flashing zero digit and simultaneously displayed horizontal lines indicative of successive positions that will be traversed by the flashing zero digit in ten-second increments during the last 59 seconds. Such graphics portray an analog of the pathway that the flashing zero digit will follow from farthest to closest positions on the left side of the next hour until the commencement thereof. Digital countdown of the corresponding 59 seconds in coordinated decile segments may be included for greater precision.

12 Claims, 4 Drawing Sheets

BICOMPONENT LAST MINUTE GRAPHICS FOR DIGITAL TIME DISPLAYS

BACKGROUND OF THE INVENTION

I. Field of the Invention

This invention relates to the graphical portrayal of the last remaining minute before each hour in certain types of digital time displays.

II. Description of the Prior Art

The prior art includes balanced, quadribalanced and enhanced quadribalanced digital time displays, as described, for example, in U.S. Pat. Nos. 4,264,966; 4,483,628; 4,627,737; 4,271,497 and 6,215,736 B1, the disclosures of which are incorporated herein by reference. These displays have the common characteristic that upon reaching the last remaining minute before the commencement of the next hour, depicted by a minute digit 1 on the left side and a zero seconds digit below the next hour digit, there are no additional minutes to be displayed. Only the last 59 seconds remain to be counted down.

III. Recognition of Problems in the Prior Art

U.S. Pat. No. 5,757,730 describes a system of graphically portraying the countdown of the last 59 seconds of a balanced digital time display in the space previously occupied by remaining minutes to the next hour. This system consists of activating six horizontal display elements of a pair of seven-segmented display elements, and then sequentially flashing each element in ten second increments down from the top to the bottom of initially the outboard segments during the initial thirty seconds, and thereafter the inboard segments during the last thirty seconds before the next hour.

A deficiency of the aforesaid system has become evident, in that while only one of the six horizontal elements is flashing during any of the six incremental ten second periods, the configuration of the flashing element is not visually different from that of the other elements which remain steady on as each of the previous flashing periods occurs. Consequently, there is not a visually different, immediately recognizable distinction between the flashing element and the steady on elements. Such a distinction is needed both to uniquely identify the flashing element and also distinguish its position relative to the others during the countdown of the last 59 seconds before the next hour, thus enhancing an analog representation of where the countdown is situated at any given time.

SUMMARY OF THE INVENTION

The present invention provides a simple and effective remedy to the above-described problem, based upon incorporating a small flashing zero as an immediately recognizable analog of the current ten second period being counted down and thus distinguished from the remaining ten second periods not yet reached during the entire 59 second interval before the next hour. Such a flashing zero could be, for example, the six one-third-sized zeros of two ten-segmented laddered arrays of display elements, which are the subject of a previous application Ser. No. 09/901,420 filed by the present inventor.

Further details of the present invention will be readily understood by reference to a specific embodiment thereof, as illustrated in the drawings and described below.

BRIEF DESCRIPTION OF THE DRAWINGS

In accordance with the present invention.

Figure 1:
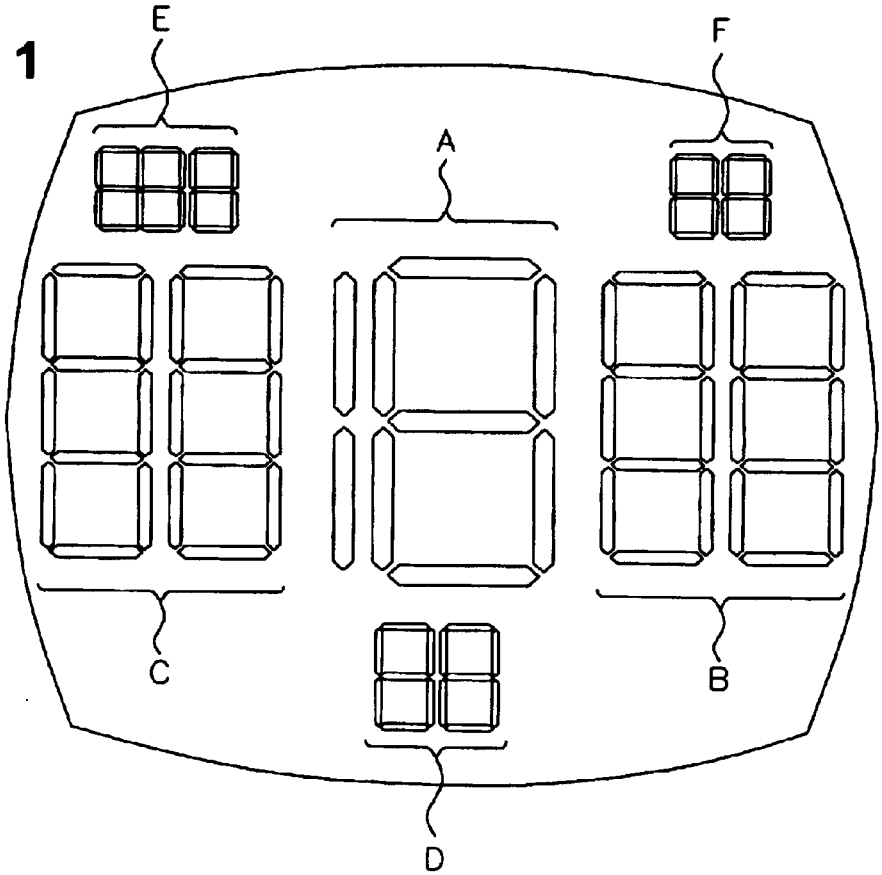
FIG. 1 illustrates a layout of digital display elements disclosed in U.S. Pat. No. 4,271,497, and also disclosed in a modified form in U.S. Pat. No. 6,215,736 B1, for performing quadribalanced and enhanced quadribalanced timekeeping, respectively.

Returning again to FIG. 1, illustrated there are six arrays or sets of digital display elements labeled A-F. Set A is activatable to display digital hours of values 1 through 12, as explained in the previously cited quadribalanced and enhanced quadribalanced patents. Set B is activatable to display elapsed minutes after a current hour, the first fifteen minutes (00–15) in a relatively upper position by activation of the uppermost seven segments of each ten-segmented ladder array, and the second fifteen minutes (16–30) in a relatively lower position by activation of the lowermost seven segments of the ladder arrays.

Set C is activatable to display 29 to 16 remaining minutes before a next hour, in a relatively lower position by activation of the lowermost seven segments of the ladder arrays, and finally 15 to 0 remaining minutes before the next hour in a relatively upper position by activation of the uppermost seven segments of the ladder arrays.

Set D is activatable to display 0 to 59 seconds during each elapsed minute and 59 to 0 seconds during each remaining minute.

Set E is activatable to display two-letter abbreviated names of the days of each week, and Set F is activatable to display the dates of the days of each month.

Figure 2:
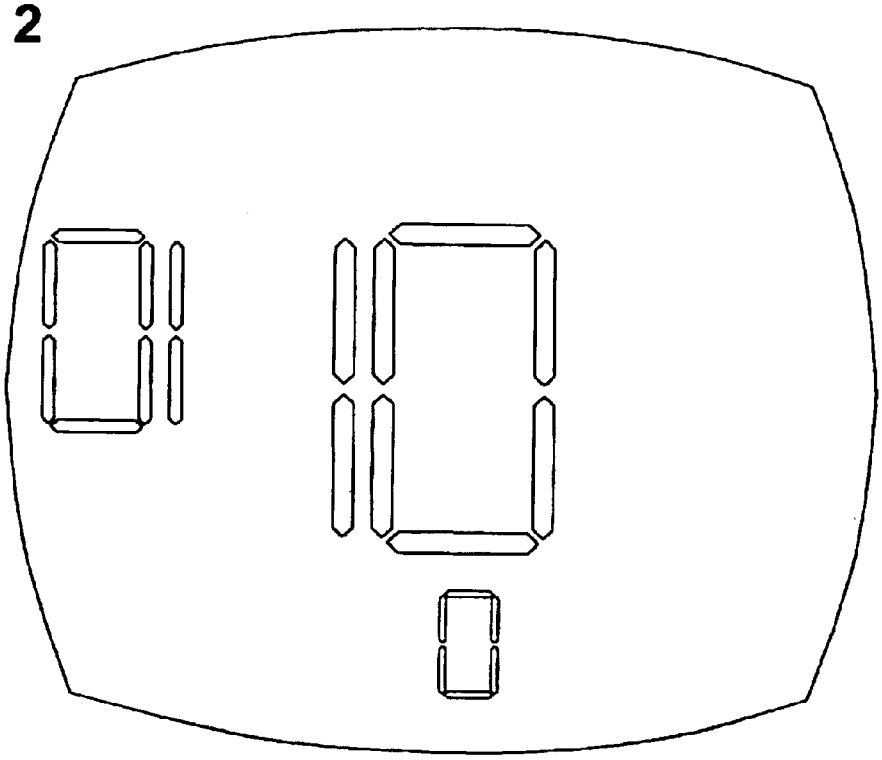
FIG. 2 illustrates activation of selected display elements of FIG. 1 to show the exact time of one minute and zero seconds before an approaching next hour ten.

Referring now to FIG. 2, this illustrates the condition of the display when the time is exactly one minute (01) and zero seconds (0) before the next hour ten (10).[1]

[1]Day names and dates are not illustrated since they are not altered by the present invention.

Figure 3:
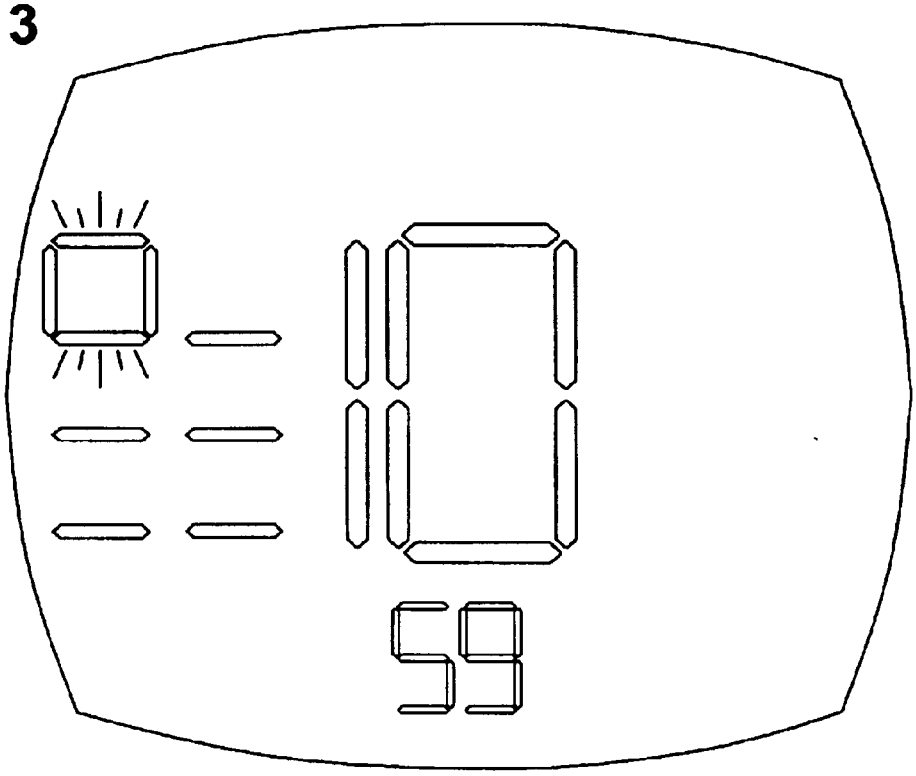
FIG. 3 illustrates the time reached one second after the time of FIG. 2, i.e. 59 seconds before next hour ten.

Referring next to FIG. 3, this illustrates the condition of the display when it begins the countdown of the final 59 seconds before the commencement of the next hour ten. As shown, the four uppermost elements of the outboard ten-segmented ladder array (relative to the hour display) are activated to display a flashing zero, signified by the ray lines. Below this flashing zero are the remaining two lowermost horizontal display elements of the same array activated into a steady on condition. Similarly, the three lowermost horizontal display elements of the inboard ten-segmented ladder array are also activated into a steady on condition. This selective activation of the FIG. 3 display is maintained during a ten-second period while seconds are counted from 59 to 50 by the elements of set D, with the zero digit flashing on each such value.

Accordingly, FIG. 3 presents a bicomponent graphical view composed of (i) the flashing zero in the uppermost, farthest position from the hour display, together with (ii) the five steady on horizontal elements positioned below and between this zero and the hour display.

The resulting effect is somewhat like a road map in which a journey of the flashing zero down the outboard ladder array to its bottom, and thereafter from the top to the bottom of the inboard ladder array, is portrayed at the outset and then tracked in ten-second increments as the flashing zero moves down through the remaining positions underscored by the steady on horizontal elements. It can be seen that the flashing zero is immediately distinguished visually from the steady on horizontal lines, and thus the progression of the descending values of the remaining seconds can be easily watched and monitored by the viewer in an analog manner, without reference to the specific digital seconds values below the next hour if that level of precision is not needed or desired. The fact that there are five steady on horizontal lines in the display alone informs the viewer that the countdown is progressing in the initial incremental ten-second period during which the seconds values are in the 50's and will terminate at precisely value 50.

Figure 4:
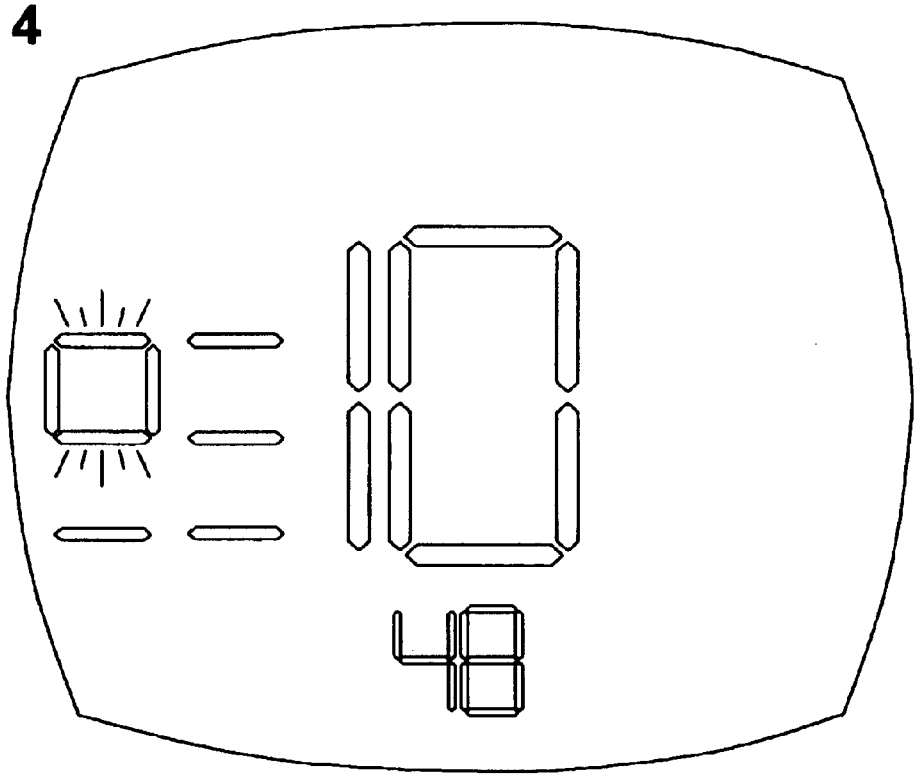
FIG. 4 illustrates 48 seconds before the next hour.

FIG. 4 illustrates the condition of the display in the next ten-second increment. The flashing zero has stepped down one level to the middle position of the outboard ladder array. The remaining four steady on horizontal lines indicate that the values of the downcounting seconds are in the 40's (i.e., 49–40), with value 48 specifically shown.

Figure 5:
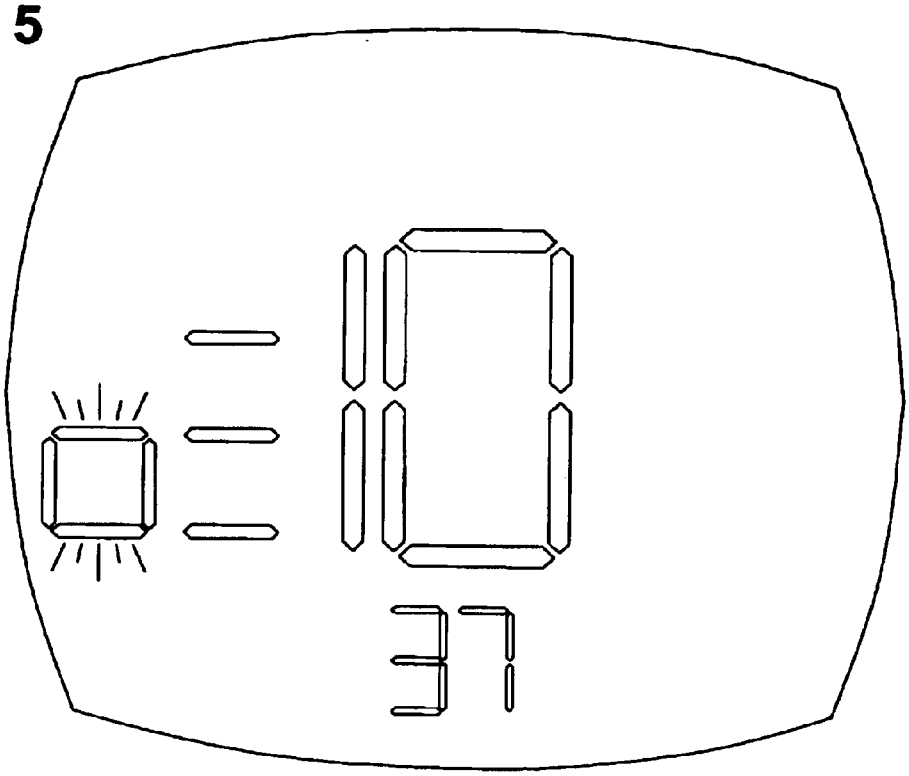
FIG. 5 illustrates 37 seconds before the next hour.

FIG. 5 illustrates the next ten-second increment of the countdown. The flashing zero has reached the lowest level of the outboard ladder array, and the three steady on horizontal lines of the adjacent inboard ladder array signify that the seconds are descending through values in the 30's (i.e. 39–30), with 22 specifically shown. At the conclusion of this countdown the last zero flash will occur at precisely 30 seconds. Thus, the end of flashing in the outboard ladder array is synchronous with completion of the countdown of the initial 30-second segment of the last remaining 60-second period before the next hour ten.

Figure 6:
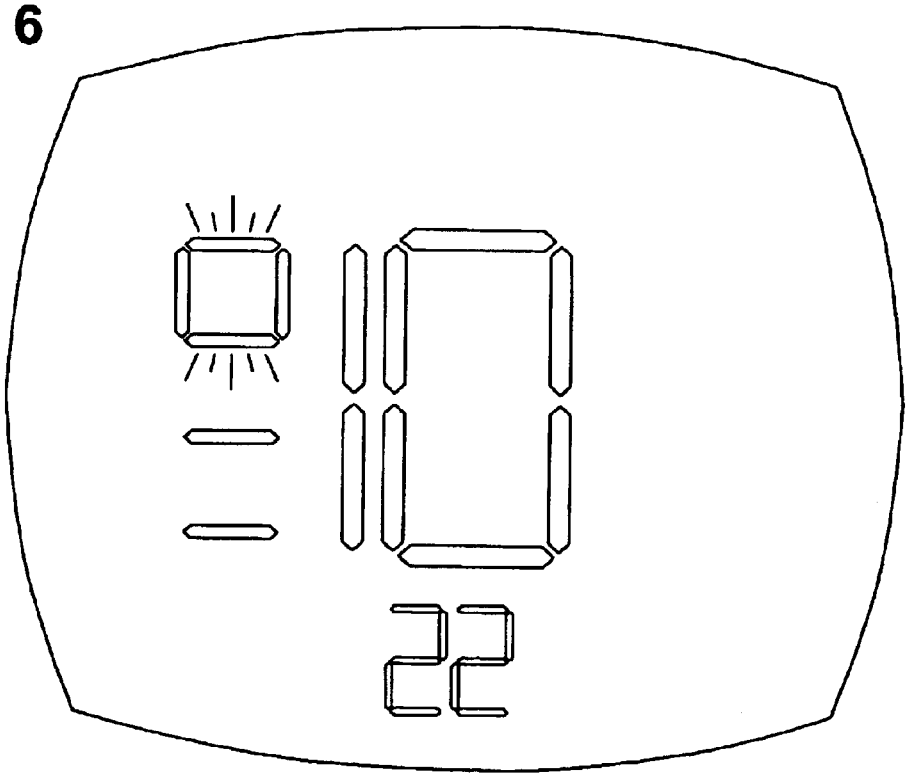
FIG. 6 illustrates 22 seconds before the next hour.

FIG. 6 illustrates the condition of the display at the commencement of the countdown of the final 30-second time period before the next hour. The flashing zero is in the uppermost level of the inboard ladder array, and the two remaining steady on horizontal lines signify that the countdown of seconds is in the values of 20's (i.e. 29–20), with value 22 specifically shown.

Figure 7:
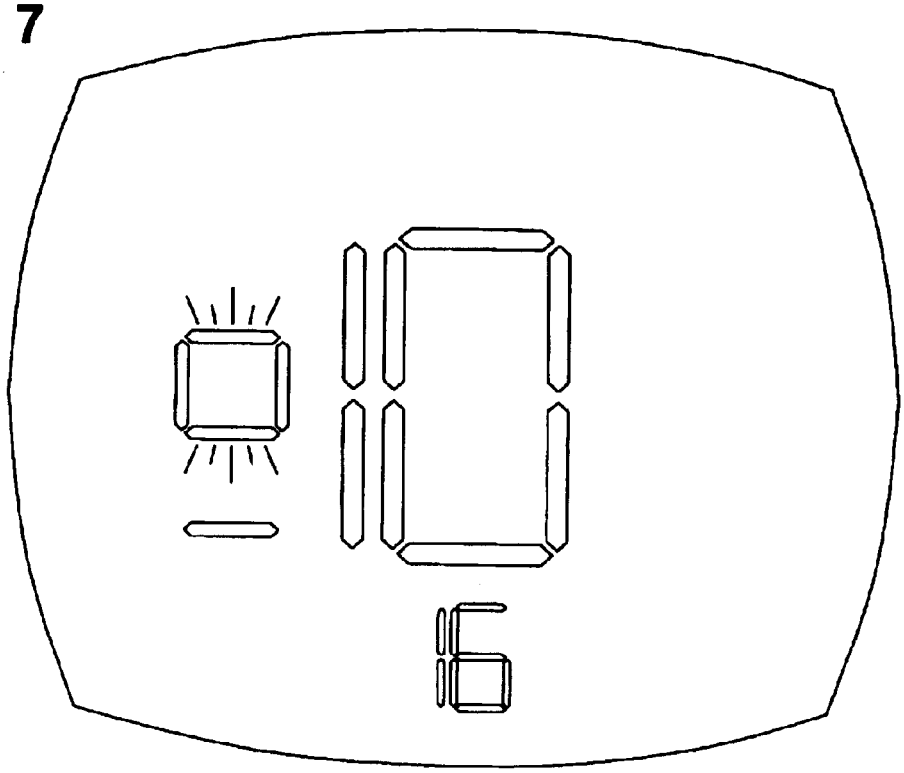
FIG. 7 illustrates 16 seconds before the next hour.

FIG. 7 illustrates the condition of the next, penultimate ten-second increment of the countdown. The flashing zero has descended to the middle and next to last level down the inboard ladder array, and the single horizontal line below signifies the countdown is progressing through values of tens of seconds (i.e. 19–10), with specific value 16 shown.

Figure 8:
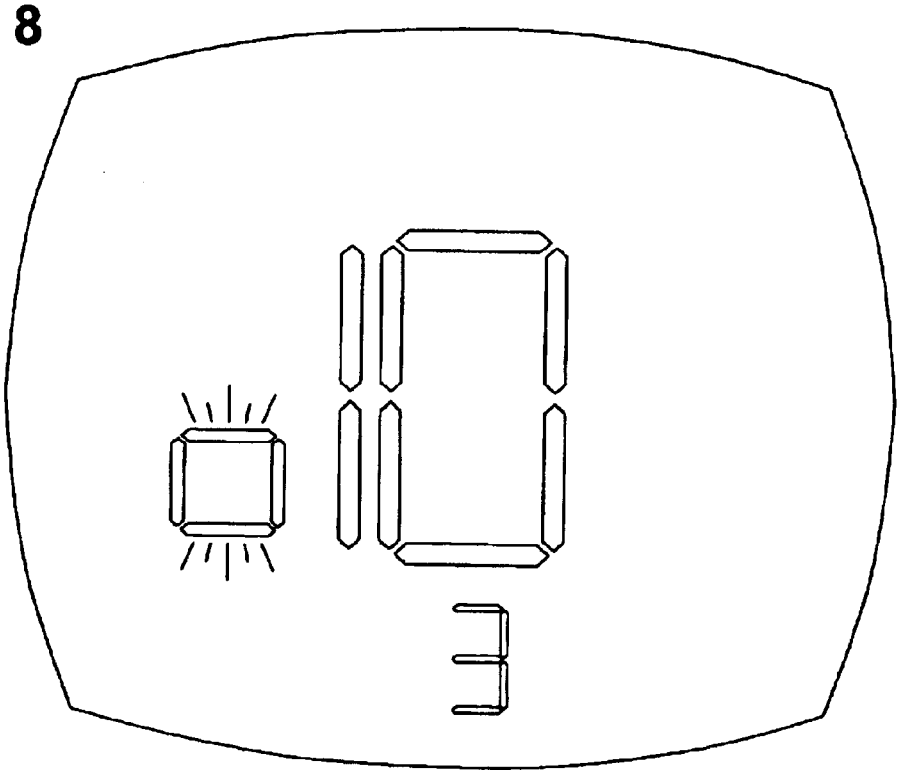
FIG. 8 illustrates 3 seconds before the next hour.

FIG. 8 illustrates the condition of the display as it is counting down the final ten seconds before commencement of the next hour. The flashing zero is now in the lowermost and nearest position to the hour display. There are no remaining horizontal lines since the seconds are being counted down through their final unit values (9–0), with value 3 specifically shown.

A specific embodiment of the invention has been described above. Its advantages are self-evident. The use of a flashing zero together with steady on lines, positioned in a road map-like picture, enables a viewer to readily recognize and monitor the travel of the flashing zero down through the steps of its pathway toward the final destination when each current hour will cease and the next one will begin. This picture provides an analog approximation of where the countdown of the last 59 seconds is situated at any given moment, in terms of the six successive and visibly distinguished ten-second increments, together with the precision of the specified seconds values during each of those increments.

The invention may be implemented in the digital displays of the previously cited patents, or in any other digital time display which includes a countdown of the last 59 seconds before a next new hour. For implementation in wristwatches, an LCD layout of digital display elements arranged as illustrated in FIG. 1 will be constructed. A microprocessor will be programmed with embedded software that will drive the display elements to activate them in the sequences described above and illustrated in FIGS. 2–8 during the last 59 seconds. The microprocessor will also drive the LCD elements to display preferably enhanced quadribalanced timekeeping during the preceding 59 minutes of each hour. A circuit board, battery, watch case and a switching mechanism, preferably the single crown control described in U.S. Pat. No. 6,286,991 B1, the disclosure of which is incorporated herein by reference, are the remaining basic assembly parts required for producing finished wristwatches utilizing the present invention. Other timepieces, e.g. clocks, clock radios, auto clocks, can be produced in similar manner.

Many variations and modifications of the specific embodiment described and illustrated above will be obvious to those skilled in the art. Therefore, it should be understood that it is intended to cover all such adaptations which fall within the literal scope of the ensuing claims and all equivalents thereof.

What is claimed is:

1. A bicomponent last minute graphical display system for digital time displays that specify digital minutes remaining before commencement of a next hour which comprises:

multiple digital display elements which are activatable to display digital next hours having values 1 to 12, additional multiple digital display elements which are activatable to display (i) remaining minutes having values 29 to 1 before the commencement of a next hour and alternatively (ii) a flashing zero digit and horizontal lines indicative of successive positions which will be occupied by the flashing zero digit during the last 59 seconds before commencement of the next hour, the flashing zero digit being activated to occupy six successive positions in successive ten-second increments while the horizontal lines are simultaneously displayed to sequentially indicate the pathway that the flashing zero digit will traverse during the last 59 seconds until commencement of the next hour.

2. A system according to claim 1 wherein the indicated pathway comprises three uppermost, middle and lowermost positions relatively outboard to the left of the displayed next hour and three uppermost, middle and lowermost positions relatively inboard to the left of the next hour.

3. A system according to claim 2 wherein during the six successive ten-second increments of the last 59 seconds the flashing zero digit traverses initially, and thereafter successively, the relatively outboard uppermost, middle and lowermost positions and next the relatively inboard uppermost, middle and lowermost positions until commencement of the next hour.

4. A system according to claim 3 wherein both the outboard and inboard three traversed positions are each arrayed in vertical alignment.

5. A system according to claim 4 wherein each horizontal line is sequentially extinguished after the flashing zero digit moves off the position indicated by said line.

6. A system according to claim 1 which comprises further multiple digital display elements which are activatable to display six successive decile segments of the last 59 seconds before commencement of the next hour, in synchronous coordination with the six successive positions of the flashing zero digit.

7. A bicomponent last minute graphical display system for a quadribalanced or enhanced quadribalanced system that specifies digital minutes remaining before commencement of a digital next hour which comprises:

multiple digital display elements which are activatable to display digital next hours having values 1 to 12, a pair of ten-segmented arrays of digital display elements, one of such arrays being positioned relatively outboard and the other array relatively inboard to the left of the hour display elements, which arrays are activatable to display remaining minutes having values 29 to 1 before the commencement of a next hour, said arrays being alternatively activatable to display a flashing zero digit that traverses initially uppermost, middle and lowermost positions of the relatively outboard array and thereafter uppermost, middle and lowermost positions of the relatively inboard array, in synchronism with ten-second increments of the last 59 seconds until commencement of the next hour, two lowermost horizontal display elements of the relatively outboard array and three lowermost horizontal display elements of the relatively inboard array being simultaneously activated to display corresponding horizontal lines at the outset of the flashing zero digit, said lines being indicative of the pathway that the flashing zero digit will traverse during the last 59 seconds until the commencement of the next hour.

8. A system according to claim 7 wherein each horizontal line is sequentially extinguished as the flashing zero digit moves off the position indicated by said line.

9. A system according to claim 7 which includes a pair of seven-segmented digital display elements positioned below the hour display elements and being activatable to count down the last 59 seconds until the commencement of the next hour.

10. A method of including a bicomponent graphical display of the last 59 seconds in a digital time display that specifies minutes remaining before commencement of a next hour which comprises:

providing multiple display elements and activating the same to display digital next hours having values from 1 to 12, providing additional multiple display elements in a pair of arrays, one relatively outboard and the other relatively inboard to the left of the next hour display elements, activating said additional elements to display remaining minutes before commencement of a next hour until one remaining minute and zero seconds is reached, thereafter activating said additional elements to form a flashing zero digit in an uppermost position of the relatively outboard array while simultaneously activating two horizontal display elements of the same array and three lowermost horizontal elements of the relatively inboard display to form five corresponding lines indicative of positions that the flashing zero will traverse during the last 59 seconds until commencement of the next hour, and activating said additional elements to successively shift the flashing zero digit in ten second increments from said uppermost position to middle and lowermost positions of the relatively outboard array and thereafter said uppermost, middle and lower most positions of the relatively inboard array, while sequentially extinguishing the five horizontal lines as the flashing zero digit moves off the position indicated by each of said lines during the last 59 seconds before the next hour.

11. A method according to claim 10 which includes providing further digital display elements below the hour display elements and activating said further elements to display decile segments of the last 59 seconds before commencement of a next hour, in synchronous coordination with the six successive positions of the flashing zero digit.

12. A method according to claim 10 which includes providing each of he relatively outboard and relatively inboard arrays in the form of ten-segmented, vertically aligned arrays and providing complementary relatively outboard and relatively inboard ten-segmented, vertically aligned arrays to the right of the hour display elements, and activating said arrays to display quadribalanced or enhanced quadribalanced timekeeping sequences prior to the display or the last 59 seconds before commencement of the next hour.

* * * * *

UNITED STATES PATENT AND TRADEMARK OFFICE

CERTIFICATE OF CORRECTION

PATENT NO. : 6,816,441 B2
DATED : November 9, 2004
INVENTOR(S) : Berj A. Terzian It is certified that error appears in the above-identified patent and that said Letters Patent is hereby corrected as shown below:

Column 3,
Line 27, “22” should read -- 37 --;

Column 6,
Line 31, “he” should read -- the --; and
Line 38, “or” should read -- of --.

Signed and Sealed this

Twenty-second Day of February, 2005

JON W. DUDAS
*Director of the United States Patent and Trademark Office*